US011659870B2

(12) United States Patent
Damir et al.

(10) Patent No.: US 11,659,870 B2
(45) Date of Patent: May 30, 2023

(54) SWADDLING DEVICE WITH ADJUSTABLE WRAP

(71) Applicant: SwaddleDesigns, LLC, Seattle, WA (US)

(72) Inventors: Lynette Damir, Seattle, WA (US); Jeffrey Damir, Seattle, WA (US)

(73) Assignee: Swaddledesigns, LLC, Seattle, WA (US)

( * ) Notice: Subject to any disclaimer, the term of this patent is extended or adjusted under 35 U.S.C. 154(b) by 0 days.

(21) Appl. No.: 17/314,031

(22) Filed: May 6, 2021

(65) Prior Publication Data

US 2022/0022559 A1 Jan. 27, 2022

Related U.S. Application Data

(63) Continuation of application No. 16/265,975, filed on Feb. 1, 2019, now abandoned, which is a (Continued)

(51) Int. Cl.
*A41B 13/06* (2006.01)

(52) U.S. Cl.
CPC ..... *A41B 13/06* (2013.01); *A41B 2300/32* (2013.01); *A41B 2300/322* (2013.01); *A41B 2300/324* (2013.01)

(58) Field of Classification Search
CPC ..... A41B 2300/32; A41B 13/06
(Continued)

(56) References Cited

U.S. PATENT DOCUMENTS

D59,012 S 9/1921 Kelly
D163,809 S 5/1947 Lehigh
(Continued)

FOREIGN PATENT DOCUMENTS

CN 111954472 11/2020
KR 10-2017-0115348 10/2017
(Continued)

OTHER PUBLICATIONS

International Search Report and Written Opinion of PCT/US2018/033268, international fiing date May 17, 2018, dated Oct. 18, 2018.
(Continued)

*Primary Examiner* — Timothy K Trieu
(74) *Attorney, Agent, or Firm* — Lowe Graham Jones LLC; Ellen M. Bierman

(57) ABSTRACT

A swaddling device is described. The swaddling device includes a sack configured to substantially enclose a baby. The sack includes sleeves and an attached wrap configured to swaddle the baby. The swaddling device at least partially restricts movement of the baby and thereby suppresses the Moro Reflex, while also snugly enveloping the torso of the baby and thereby providing constant moderate pressure thereto. The wrap is sufficiently narrow so as not to restrict movement of the baby's hips and knees, while also providing access to the lower portion of the baby for diaper changes. Some versions of the device include sleeves having at their ends foldover mitten cuffs or other selectively openable mechanism. The cuffs allow a caregiver to expose the hand or hands of the baby so as to provide skin-to-skin contact. Alternatively, the caregiver can close the cuffs if scratching is a concern.

29 Claims, 11 Drawing Sheets

Related U.S. Application Data continuation-in-part of application No. 15/982,911, filed on May 17, 2018.

(60) Provisional application No. 62/625,864, filed on Feb. 2, 2018, provisional application No. 62/507,742, filed on May 17, 2017.

(58) Field of Classification Search
USPC ..... 2/69.5
See application file for complete search history.

(56) References Cited

U.S. PATENT DOCUMENTS

| | | | |
|---|---|---|---|
| 2,496,922 | A | 2/1950 | Virtue |
| D168,887 | S | 2/1953 | Friedman |
| 2,677,130 | A | 5/1954 | D'Hayer |
| D296,378 | S | 6/1988 | Coates |
| 4,901,371 | A | 2/1990 | Christians |
| 5,129,406 | A | 7/1992 | Magnusen et al. |
| 5,621,917 | A | 4/1997 | Howsden |
| D413,423 | S | 9/1999 | Forrest |
| D446,907 | S | 8/2001 | Hall et al. |
| D514,279 | S | 2/2006 | Lindquist |
| 7,246,392 | B2 | 7/2007 | Schmid et al. |
| D650,153 | S | 12/2011 | Chopak et al. |
| D669,659 | S | 10/2012 | Barski |
| 8,607,364 | B2 | 12/2013 | Barski |
| D716,526 | S | 11/2014 | Harris |
| 8,898,833 | B2 | 12/2014 | Coates |
| 9,003,564 | B2 | 4/2015 | Wynh |
| D728,198 | S | 5/2015 | Barski |
| D728,199 | S | 5/2015 | Barski |
| 9,119,423 | B2 | 9/2015 | Gotel et al. |
| 9,179,711 | B2 | 11/2015 | Krawchuk |
| D772,532 | S | 11/2016 | Karp |
| D801,630 | S | 11/2017 | Wollschlaeger et al. |
| D802,252 | S | 11/2017 | Sack |
| D802,253 | S | 11/2017 | Sack |
| D806,354 | S | 1/2018 | Calodoukas |
| D901,835 | S * | 11/2020 | Bykov ..... D2/719 |
| RE48,330 | E * | 12/2020 | Zeidman ..... A01M 1/2016 |
| 2011/0179546 | A1* | 7/2011 | Millette ..... A41B 13/06 2/75 |
| 2011/0180079 | A1 | 7/2011 | Krawchuk |
| 2012/0047621 | A1 | 3/2012 | Bocchino |
| 2014/0165257 | A1 | 6/2014 | Wynh |
| 2015/0000036 | A1 | 1/2015 | Krawchuk |
| 2016/0113331 | A1 | 4/2016 | Blacker |
| 2016/0128392 | A1 | 5/2016 | Krawchuk |
| 2016/0174619 | A1 | 6/2016 | Waters et al. |
| 2016/0295928 | A1 | 10/2016 | Bopanna |
| 2016/0353809 | A1 | 12/2016 | Barski |
| 2017/0311663 | A1 | 11/2017 | Wollschlaeger et al. |
| 2018/0332902 | A1 | 11/2018 | Damir et al. |
| 2019/0208831 | A1 | 7/2019 | Joshi |
| 2019/0254355 | A1 | 8/2019 | Griffin |

FOREIGN PATENT DOCUMENTS

| | | |
|---|---|---|
| WO | 2007098558 | 9/2007 |
| WO | 2012142210 | 10/2012 |
| WO | 2016118809 | 7/2016 |

OTHER PUBLICATIONS

International Search Report and Written Opinion of PCT/US2019/016435, international filing date Feb. 1, 2019, dated May 16, 2019.
European Search Report for European Application No. 18802209.9, dated Feb. 17, 2021.
European Search Report for European Application No. 19747993.4, dated Feb. 21, 2021.

* cited by examiner

SWADDLING DEVICE WITH ADJUSTABLE WRAP

CROSS REFERENCE TO RELATED APPLICATIONS

This application is a continuation of U.S. patent application Ser. No. 16/265,975, filed on Feb. 1, 2019; which claims the benefit of priority from U.S. Provisional Patent Application No. 62/625,864, filed on Feb. 2, 2018; U.S. patent application Ser. No. 16/265,975 is also a continuation-in-part of U.S. patent application Ser. No. 15/982,911, filed on May 17, 2018; which claims the benefit of priority from U.S. Provisional Patent Application No. 62/507,742, filed on May 17, 2017, the entire contents of each of the above-referenced applications is incorporated herein by reference.

TECHNICAL FIELD

The present disclosure relates to a swaddling device for infants.

BACKGROUND

Typical prior art swaddling devices do not allow a baby to have skin-to-skin access to his or her hands. An example prior swaddling pod design that prevents baby from accessing his or her hands is described in U.S. Pat. No. 8,607,364. This prior swaddling pod design, which prevents access to baby's hands to suck and self-soothe, is not in baby's best interest, because it is very important for baby to have access to its hands.

Another example prior swaddling pod design is described in U.S. Pat. No. 9,179,711. The described design is a sleeping sack that allows baby to suck on its hands through the fabric of the sack, but without direct skin-to-skin access. This prior swaddling pod design, which requires baby to suck through the fabric, is not ideal or in baby's best interest, because skin-to-skin contact is more natural. In addition, if baby is sucking on fabric then baby will be ingesting residual detergent or fabric softeners on the fabric after washing and drying the garment.

Another prior swaddling device design is described in U.S. Pat. No. 7,246,392. The described design restrains the baby's arms with a large and wide wrap feature, typically including a hook-and-loop fastener. The width of the wrap in this design, extending below the waist, makes it difficult for the baby to flex and/or extend its hips and knees. If used improperly or pulled overly tight by parent, this design impairs mobility which increases risk of hip dysplasia. In addition, since the wrap extends significantly below the baby's waist, it is not possible to change a diaper without removing the wrap.

Furthermore, prior art designs do not include integrated sleeves in combination with a wrap or mechanism to restrain baby's arms. In addition, many babies prefer to sleep with one or both of their arms above their head and unrestrained, and prior art designs do not provide any functionality to suppress or partially suppress the Moro reflex when the arm out of the wrap. Thus, typical prior art designs fail to address this need by providing an option for the baby to sleep with one or more arms in sleeves and outside of the wrap.

DETAILED DESCRIPTION

Figure 1A:
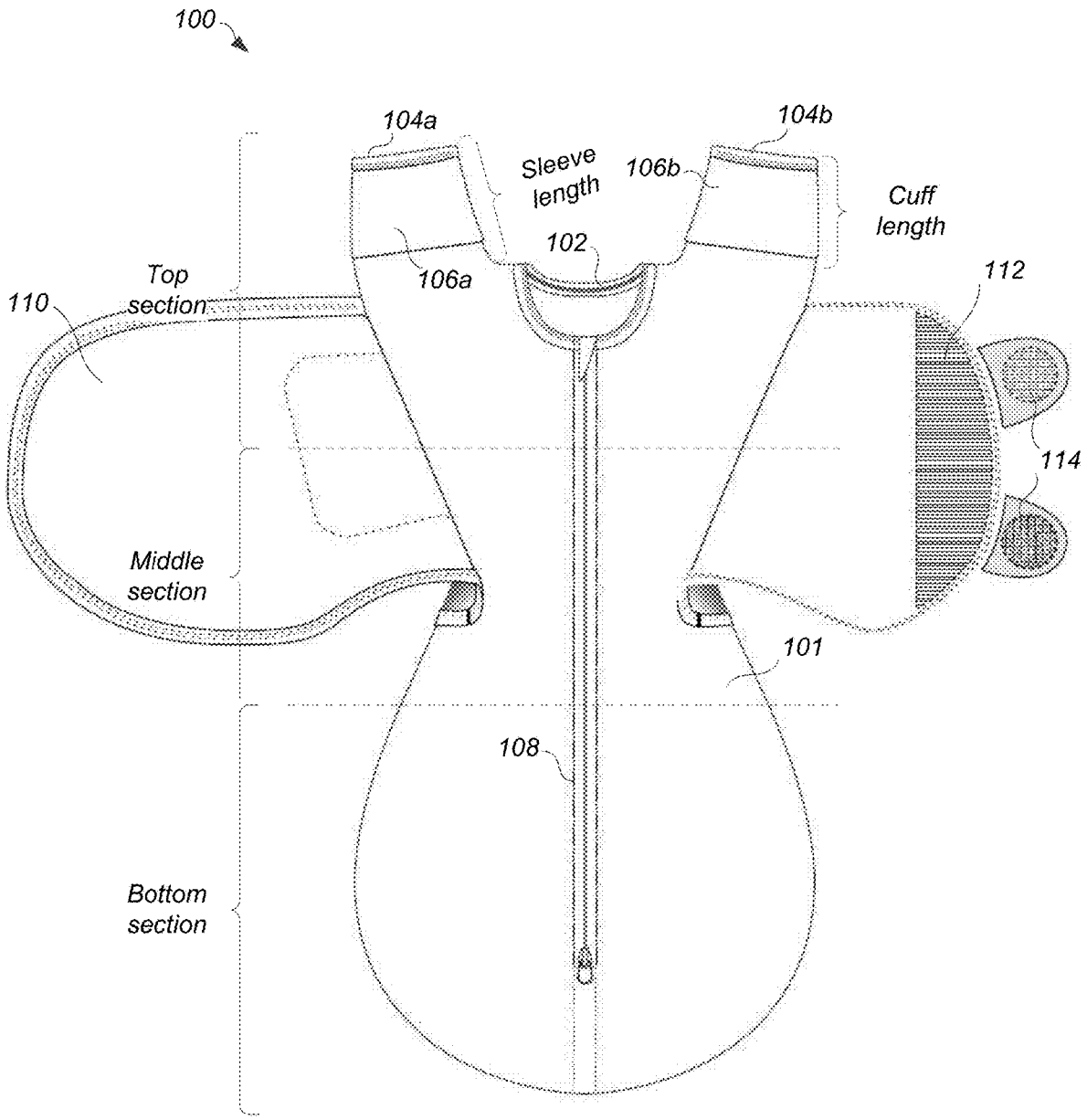
FIGS. 1A and 1B are line drawings showing front and rear views of a swaddling device according to a first embodiment, where its cuffs are in an open position.

Embodiments described herein provide a swaddling device, sometimes referred to as a Swaddle Sack with Adjustable Wrap ("SSAW"). The SSAW is an innovative swaddle pod, wearable blanket, sleeping sack for a baby. The SSAW includes an attached adjustable wrap that is operable to swaddle the baby. Some embodiments of the SSAW also include uniquely modified and shaped sleeves with foldover mitten cuffs to allow the baby to have full access to hands to self-soothe, and the design supports multiple natural arm position options for baby.

The SSAW innovative design provides a number of benefits of safety and ease of use for the caregiver. The SSAW provides several different options for its use. In a first configuration, the baby can be swaddled with both arms on its chest or on baby's center line, either with hands down or up, close to the face. Having the hands near its face allows the baby to self-soothe as described further below. In a second configuration, the baby can be swaddled with one arm outside the wrap. Wrapping the baby in this manner provides the swaddling benefit with partial suppression of the Moro reflex for the arm outside of the wrap accomplished by the sleeve and cuff design. In the third configuration, the baby can be swaddled with both arms outside the wrap. Wrapping the baby in this manner provides the swaddling benefit of pressure on the torso of the baby and with partial suppression of the Moro reflex for the arms outside the wrap accomplished by the sleeve and cuff design, while also providing a safety benefit, by giving the baby increased mobility in case the baby rolls over on its stomach.

The SSAW includes a swaddling wrap with hook-and-loop fasteners to allow the caregiver to easily swaddle baby's arms close to baby's body. For many newborn babies from 0 to 3 months, research has shown that allowing baby to self-soothe by allowing access to his or her hands when arms are snugly swaddled can reduce awakenings caused by the Moro reflex. For some newborn babies, access to his or her hands may lead to baby scratching his or her face which causes distress for parents and baby, and for babies with a propensity to scratch, the parent will have the option close the foldover cuff to prevent scratching and allow baby to suck on hands through the cotton fabric.

The SSAW wrap is relatively narrow compared to prior art swaddles, which typically extend below the baby's hips or even knees. The narrow wrap of the SSAW provides a number of benefits. The narrow wrap provides room for baby's hips and knees in the up and out position (flexed and abducted) and provide range of motion for baby's legs as recommended by the International Hip Dysplasia Institute. In addition, the narrow wrap allows access for diaper changing without the need to remove the wrap.

Some embodiments of the SSAW include foldover mitten cuffs, an important innovation that allows the caregiver two options for providing baby access to his or her hands. In a first option, the SSAW allows the baby to have skin-to-skin (hand to mouth, hand to hand, hand to face) access to his or her hands via the foldover mitten cuffs in the open position. In a second option, the SSAW allows the hand opening to be closed via the foldover mitten cuff should the caregiver choose to do so, and baby can still bring hands to face for self-comfort.

The SSAW foldover mitten cuff feature is innovative and important because other available swaddling pod designs do not allow baby to have skin-to-skin access to his or her hands. As discussed above, prior art swaddling pods do not allow for skin-to-skin contact with baby's hands. In contrast, in the open cuff position, the SSAW provides ample opportunity for baby to access and experience skin-to-skin contact with his or her hands.

This SSAW design is innovative and allows for supporting baby in a natural position with access to hands. It is very important for baby to be able to self-soothe and suck on his or her hands to communicate to caregiver that baby is hungry and ready to feed. Sucking vigorously on hands is a sign of hunger and the first baby cue. Crying is a late sign of hunger. Infant researchers and infant specialists believe the first communication between baby and caregiver is important, so the caregiver can respond appropriately and feed baby on this cue. This early act of cue met by feeding establishes trust, the foundation of healthy relationships. Lactation specialists believe this baby cue is important for breastfeeding mothers to help establish breastfeeding, milk let down and supply, and baby led feeding routines. Sucking on hands also helps the maturation of the infant's gastrointestinal tract, maturation of hand control, and also provides comfort to the baby. Sucking is the most organizing behavior to the baby, and helps with sleep/wake control. Additionally, babies have many nerve endings on their hands and around their mouth by which they learn, comfort, and communicate.

Prior swaddling pod designs allowed baby to suck on hands by sucking through the fabric, but baby care and lactation experts agree that it is important for baby to have direct skin-to-skin access to hands without a layer of fabric. In addition, given the risk that detergent and chemicals may be in the fabric after washing, it is safer and preferred for the baby to not suck on the fabric, which will minimize exposure and risk related to detergent and chemicals in the fabric.

The SSAW is designed to support baby with swaddle-like support to suppress the Moro Reflex and allow baby to sleep on his or her back in a natural supported position with multiple arm position options and enjoy the benefits of swaddling which include baby sleeps longer with fewer awakenings due to the Moro or startle reflex. The design is optimized for baby's lower-region, mid-region, and upper-region as described below.

In the lower-region (hips and legs), the SSAW is not tight around hips and legs, and allows hips and knees to flex, and provides ample room to move its legs. In the mid-region (torso), the Swaddle Sack with Adjustable Wings is relatively snug to provide support around the mid-section, and tummy, which helps baby to feel secure.

In the upper-region (chest, arms and hands), the SSAW is snug, but not overly tight, restrains movements related to the Moro Reflex with the attached wrap. The SSAW with uniquely shaped sleeves allows for multiple arm positions combined with multiple configurations for the foldover cuffs (when they are present in a particular embodiment), including: (1) both arms flexed and placed at mid-line with both hands uncovered by the open foldover cuffs and available to baby for skin-to-skin sucking for baby cues and to self-soothe; (2) both arms flexed and placed at mid-line with one hand covered by the foldover cuff and one hand uncovered and available to baby for skin-to-skin sucking for baby cues and to self-soothe; (3) both arms flexed and placed at midline with both hands covered, but within reach of mouth for self-soothing; (4) one arm extended above shoulder with hand covered or uncovered and one arm at midline with hand covered or uncovered; (5) both arms extended over shoulders with hands covered or uncovered.

In some embodiments, important benefits flow from the combination of the herein-described foldover cuffs, sleeve design, and narrow wrap. In particular, when the cuffs are closed, the baby cannot easily use its hands to get under the bottom edge of the wrap and pull the wrap up to its neck and face region, which can lead to unsafe conditions. Thus, the cuff and sleeve design work in conjunction with the narrow wrap to yield safety benefits and benefits including improved access for diaper changes and increased mobility of the hips and knees.

FIGS. 1A, 1B, 2A, and 2B are line drawings showing various views and configurations of a swaddling device 100 according to a first embodiment. As shown in FIG. 1A, the swaddling device 100 includes a sack portion 101 having a neck opening 102, a first sleeve 104*a*, a second sleeve 104*b*, a wrap 110, and a 2-way zipper 108 to allow ingress and egress for a baby. In other embodiments, snaps or other fasteners may be used instead of the zipper 108.

The wrap 110 is configured to securely swaddle the baby. The wrap 110 is typically at least as long as the maximum circumference of the sack portion of the device 110. The wrap 110 includes a first loop fastener portion 112, two hook fastener portions 114, and a second loop fastener portion 116 on the rear of the wrap (visible in FIG. 1B). The two hook fasteners 114 can be removably attached either to the first loop fastener portion 112 prior to laundry or to the second loop fastener portion 116 when the baby is swaddled in the wrap 110. As can be seen in the rear view (FIG. 1B) of device 100, the wrap 110 is formed from a panel of fabric with the attached loop fastener portion 116. In this example, the portion 116 is substantially rectangular with rounded corners. In other embodiments, additional or different shaped portions may be employed, such as ovals, circles, or the like.

As noted, the wrap 110 is uniquely dimensioned to provide specific benefits to the baby and caregiver. As shown in the rear view of FIG. 1B, the wrap 110 extends along a first axis 120 that is perpendicular to a second axis 122 that runs from the neck opening to the bottom of the sack. The length of the wrap is measured along the first axis 120, and is longer than the circumference of the sack portion of the device. In some embodiments, the wrap is at least 1.5 times the circumference of the sack, so that there is sufficient fabric to secure the baby and attach the hook and loop fasteners.

Figure 2A:
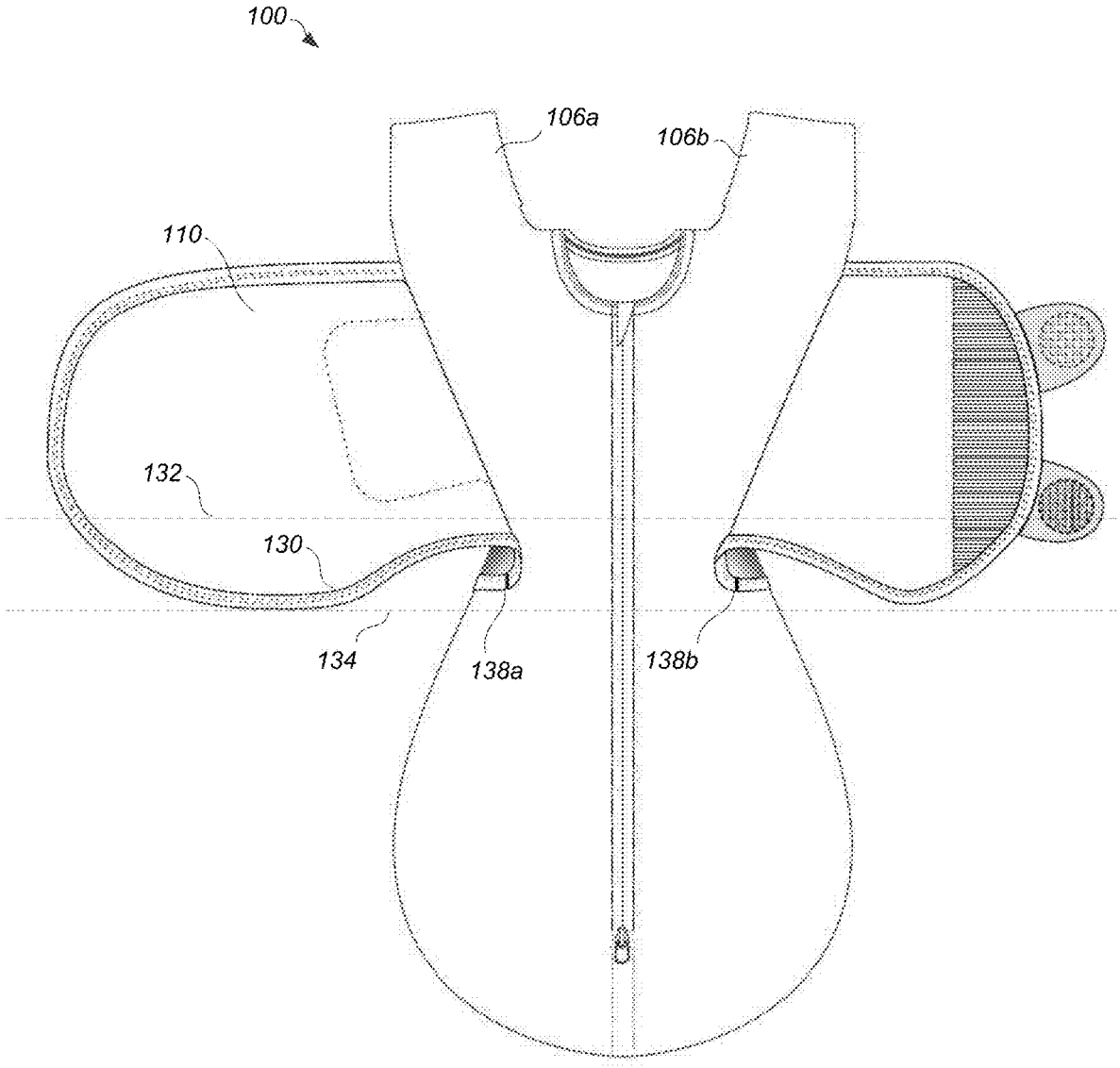
FIGS. 2A and 2B are line drawings showing front and rear views of the swaddling device according to the first embodiment, where its cuffs are in a closed position.
Figure 2B:
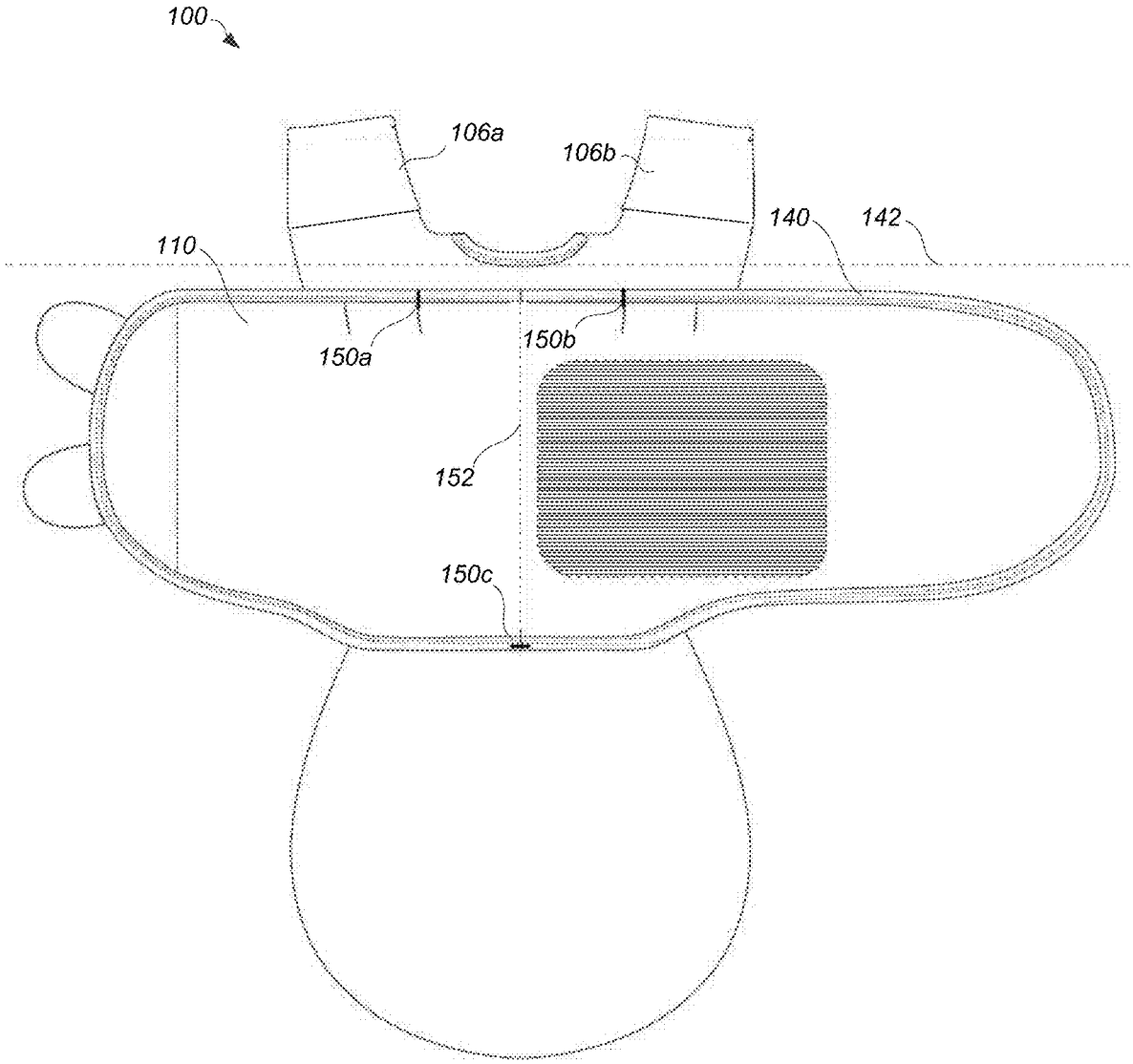

As discussed above, the wrap 110 is relatively narrow compared to prior art designs. In addition, the wrap is relatively "short" in that it does not extend far below the mid-section of the device 100. In some embodiments, the wrap 110 does not extend beyond the top of the baby's hips. As seen in FIG. 2A, the wrap 110 has a bottom edge 130 that is a maximum distance below the narrowest portion of the sack, as measured between reference lines 134 and 132. In addition, as seen in FIG. 2B, the wrap 110 has a top edge 140 that is below the neck opening as shown with respect to reference line 142. In the illustrated embodiment, the top edge 140 is about an inch below the neck opening. In different embodiments, the wrap has a maximum width (measured between the top edge 140 and bottom edge 130) that is of one of: 10, 11, 12, and 13 inches.

Some embodiments employ a unique combination of fasteners to attach the wrap 110 to the sack portion of the device 100. As seen in the front view of FIG. 2A, the wrap 110 is attached to a front panel of the sack via two attachments 138*a* and 138*b*. The attachments 138 include multiple stitches to reinforce a connection between the wrap 110 and the front panel of the device 100. In this embodiment, the attachments 138 are placed about 1 inch from the side seams (not visible) which join the front and rear panels of the sack. The attachments 138 function to stop the baby from pulling up on the wrap 110 and possibly maneuvering the wrap up to its neck and face region, thereby reducing the risk of impairing access to fresh air and reducing risk of suffocation. Research has shown that impairing access to fresh air will lead to rebreathing and increases risk of SIDS. Additional attachments may be used. For example, in the rear view of FIG. 2B, the wrap 110 is attached to the rear panel of the sack via a center stitch line 152 and attachments 150*a-c*.

Figure 1B:
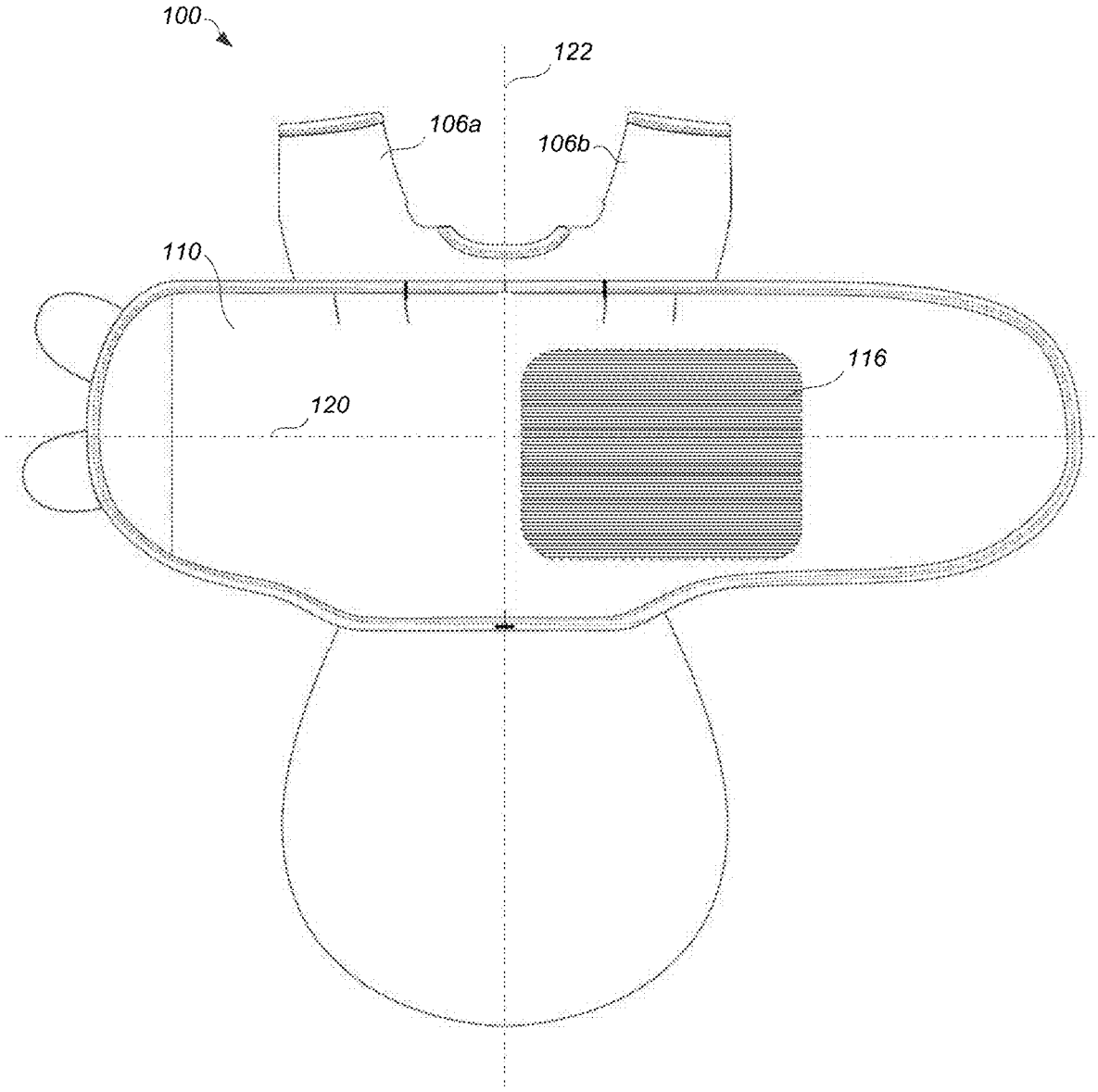

Some embodiments of the device 100 include foldover mitten cuffs. As seen in FIG. 1A, each sleeve 104 includes a corresponding foldover mitten cuff 106 ("foldover cuff" or "cuff"). Each foldover cuff 106 is selectively openable by a caregiver. FIGS. 1A and 1B respectively show front and rear views of the device 100, with the cuffs 106 in the open position. In this position, the cuff 106 allows baby, when the arms are not swaddled by the wrap 110, to extend a hand through the sleeve opening, thereby allowing baby to give baby cues and self-soothe by sucking on his or her hand(s).

Each cuff 106 is dimensioned so that when it is in the closed position, it is extremely difficult if not impossible for the baby to open the cuff 106. As shown in FIG. 1A, each cuff 106 has a length that can be measured along a longitudinal axis of the corresponding sleeve. The cuff length is sufficiently long such that, when the cuff is closed, it forms a deep "pocket" that cannot easily be reversed by force applied to the end of the cuff by extension of the baby's hand/arm. The deep pocket further prevents the baby from wriggling its hand through the layers of material in the closed cuff 106. In some embodiments, each cuff 106 has a length of at least 2.5 and preferably 2.75 inches.

The sleeves of the device 100 are also dimensioned to keep the baby's hands closer to the baby's head and body. As can be seen in FIG. 1A, the length of each sleeve, measured from the shoulder of the device 100 to the end of the sleeve 104, is relatively short in comparison to the arm length of a typical baby. In some embodiments, the sleeves are between 3.0 and 4.0 inches in length. The short sleeve length (along with other features discussed herein) allows the device 100 to provide partial suppression of the Moro reflex when baby's arm or arms are outside of the wrap. The sleeves provide some constraint for the baby's arms, but not as much as would be provided by a swaddling blanket or a swaddling device which serves to lock down the baby's arms.

The sleeves extend upwards in a Y-shaped configuration with the distal ends above the shoulder line of the swaddling device 100. As noted above, the shorter than standard sleeves with mitten cuffs closed and provide resistance to prevent full extension. The sleeve shape is contoured to follow the arm position of a baby sleeping in a natural position with hands above its head. The sleeves each allow sufficient room for baby's arms and hands to be contained in the sleeve portion, thereby allowing baby to sleep in multiple natural positions including hands on chest, hands in-line with the shoulders with elbows by side of body, arms reaching above shoulders in the touchdown position. The sleeves allow for limited movement, and provide partial suppression of arm movements related to the Moro Reflex.

FIGS. 2A and 2B respectively show front and rear views of the device 100, with the cuffs 106 in the closed position. When the cuff 106 is in the closed position, it contains baby's hands in the sack to prevent the baby from extending his or her hands out of the sack for caregivers who are concerned with facial scratching. Note that in this and other embodiments, the foldover cuffs may be configured so that they are in the closed position when folded from front to back (as shown) or so that they are in the closed position when they are folded from back to front.

The swaddling device 100 is designed to support baby with swaddle-like support to suppress the Moro Reflex and allow baby to sleep on his or her back in a natural supported position with multiple arm position options, and enjoy the benefits of swaddling which include baby sleeps longer with fewer awakenings due to the Moro or startle reflex.

The swaddling device 100 includes three distinct sections or regions, each of which is optimized to provide one or more important functions or supports for the baby. In the bottom section (hips and legs), the device 100 is not tight around hips and legs, and allows hips and knees to flex, and provides ample room to move legs. In the middle section (torso), the device 100 is relatively snug to provide support around the mid-section, and tummy, which helps baby to feel secure. In the top section (chest, arms and hands), the device 100 is snug, but not overly tight, partially suppressing movements related to the Moro Reflex and allows for multiple arm position options for baby to sleep in a natural and comfortable position. Arm position options include: arms flexed and hands placed at mid-line inside the sack; arms-up and hands in-line with shoulders and inside the sack; arms-up and hands above the shoulders inside the sack; or arms-up and hands outside the sack and available to baby for skin-to-skin sucking for baby cues and to self-soothe.

Figure 3A:
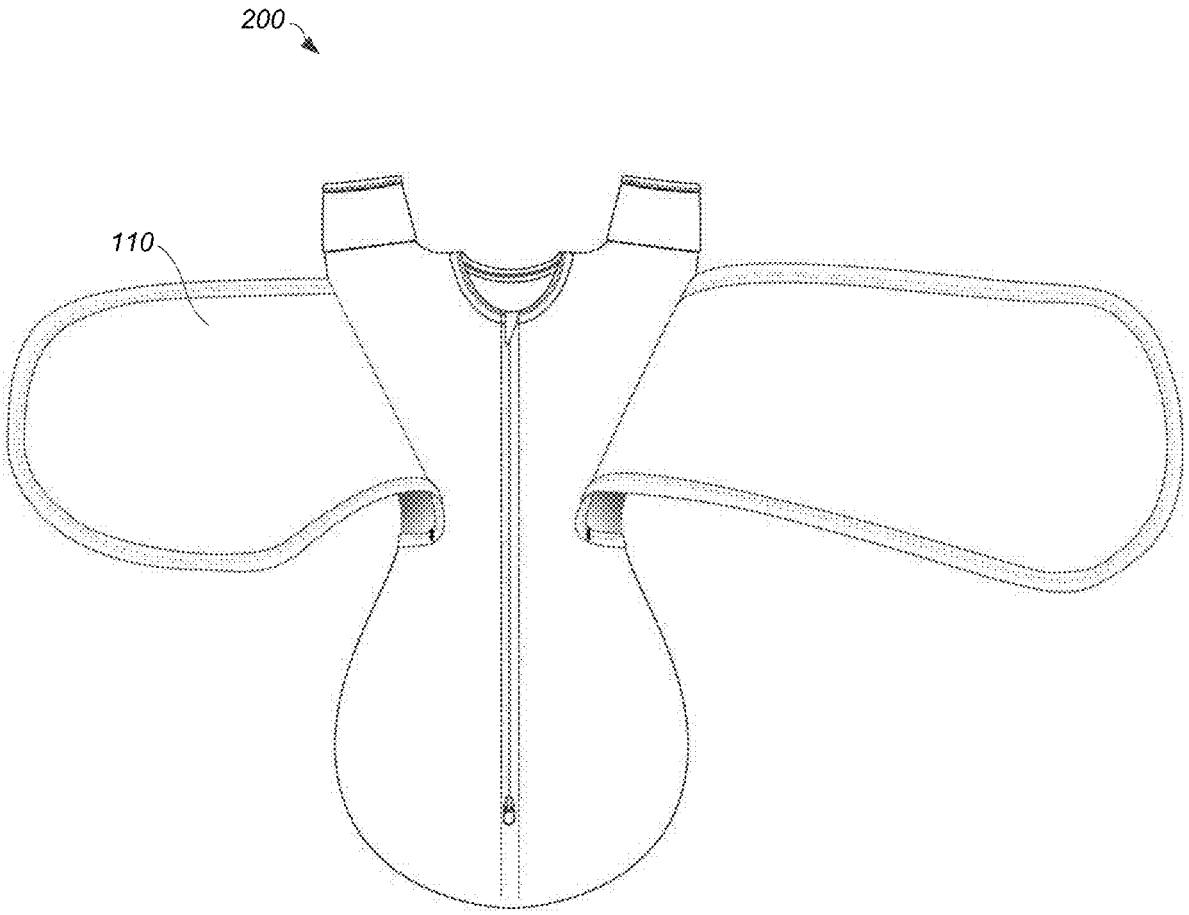
FIGS. 3A and 3B are line drawings showing front and rear views of a swaddling device according to a second embodiment, where its cuffs are in an open position.
Figure 3B:
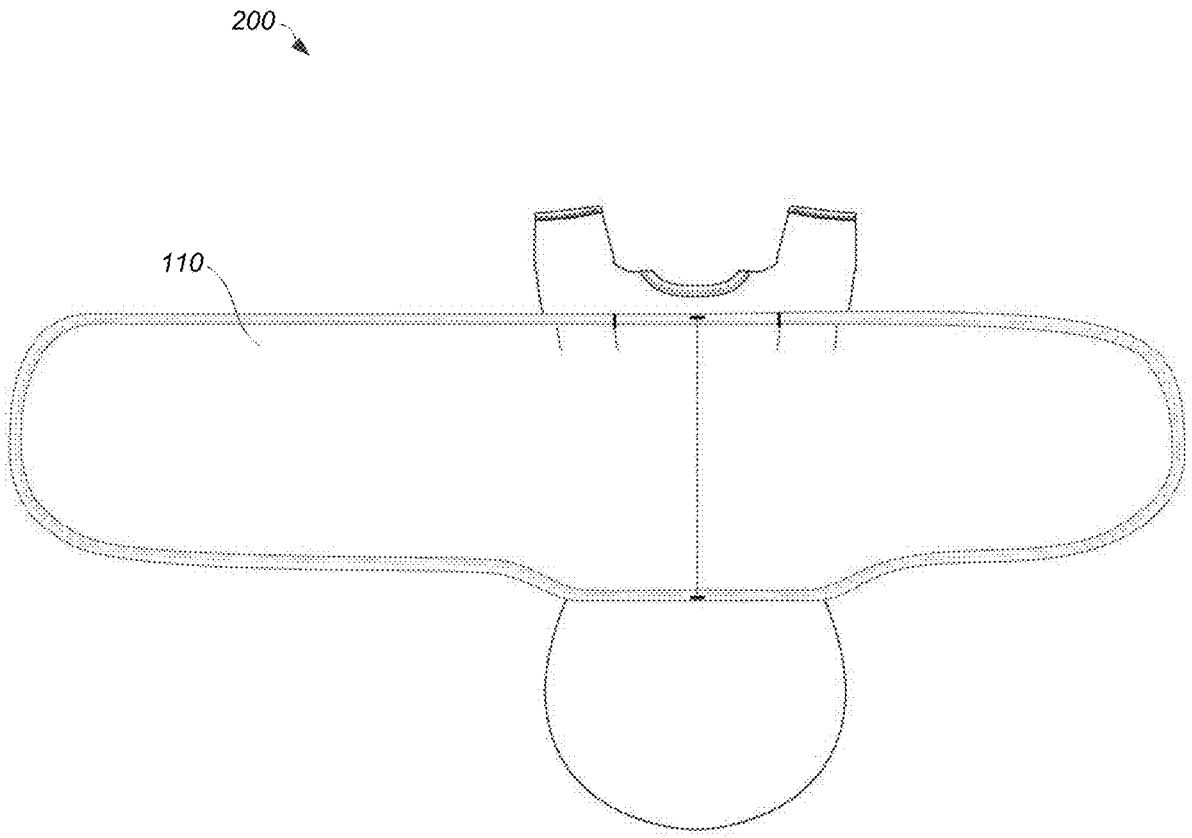

FIGS. 3A and 3B show front and rear views of a second embodiment of a swaddling device 200 according to a second embodiment. The device 200 differs from the device 100 of the first embodiment (FIGS. 1 and 2) in that the wrap 110 of device 200 is longer and does not include any fasteners. Note that the wrap 110 shown here also includes fasteners to the front side of the device 100, to inhibit upward motion of the wrap 110.

Figure 4:
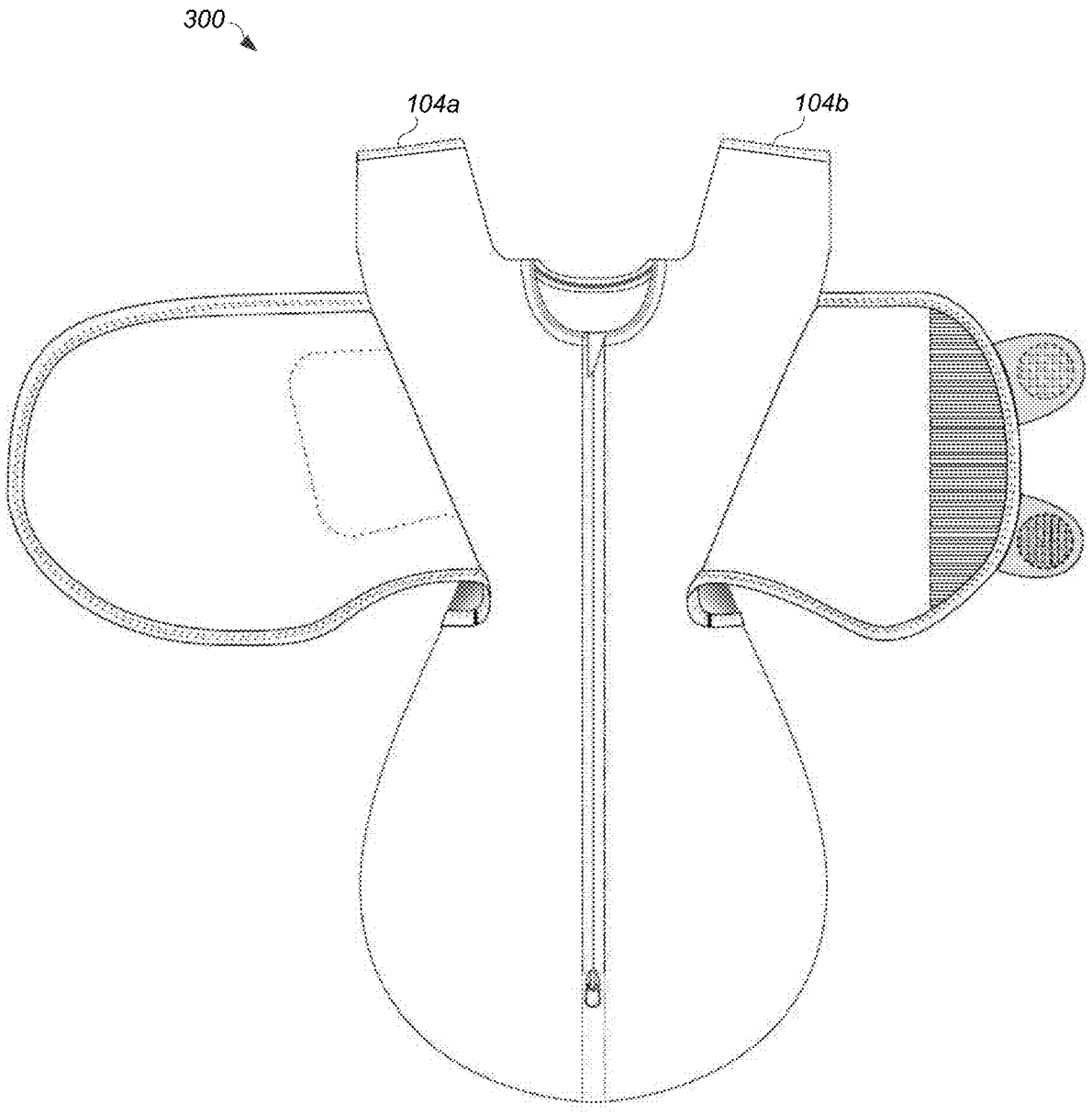
FIG. 4 is a line drawing showing a front view of a swaddling device according to a third embodiment, which does not have foldover mitten cuffs.

FIG. 4 shows a front view of a third embodiment of a swaddling device 300. The device 300 differs from the device 100 of the first embodiment (FIGS. 1 and 2) in that the device 300 does not include foldover mitten cuffs. While three embodiments have been shown and described above, the various features may be combined differently in other embodiments. For example, another embodiment may include a long wrap with fasteners and without foldover cuffs.

Figure 5:
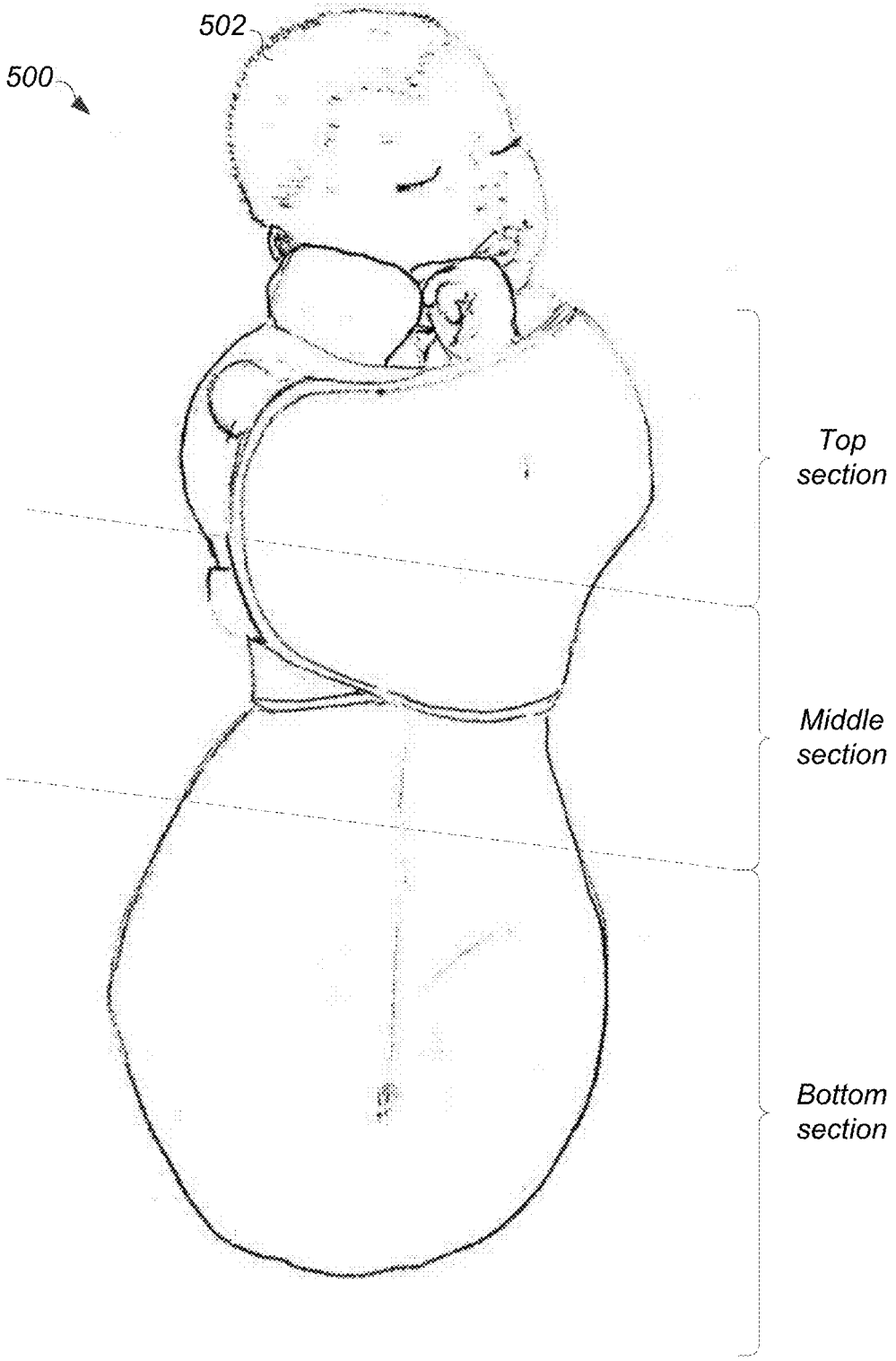
FIG. 5 is a line drawing showing a baby in an example embodiment of the swaddling device.

FIG. 5 is a line drawing showing a baby 502 within a swaddling device 500 according to an example embodiment. Note that the baby's left hand is exposed, while its right hand is securely contained by the wrap within the openable sleeve.

FIG. 5 also illustrates the relative dimensions of the top, middle, and bottom sections with respect to the size of the baby's body. In the top section, the sleeves and chest of the device 600 (not shown under the wrap) are relatively tight, so as to reduce and suppress upper body movements associated with the Moro Reflex. In the middle section, the device 600 is relatively snug about the baby's stomach region. The snugness in this region helps baby feel secure. In the bottom section, the device 600 is sufficiently spacious so as to allow baby's hips and knees to flex, while reducing and partially suppressing lower body movements associated with the Moro Reflex.

The top, middle, and bottom sections of the swaddling device are dimensioned to sizes that have been determined by the inventors to provide the advantages described above, including suppression of the Moro Reflex, hip health, and the like. In some embodiments, the middle section of the swaddling device has a circumference in the range 13-17 inches, where the circumference varies depending on whether the device is constructed for a preemie, newborn, or older baby size. The circumference of the middle section is designed to be 5-10% less than the circumference of the baby's stomach. The smaller circumference, coupled with the use of stretchy fabric construction, provides moderate constant pressure on the stomach of the baby.

In contrast to the dimensions of the middle section, the maximum circumference of the bulb-shaped bottom section may be in the range 21-26 inches. In relative terms, the maximum circumference of the bottom section is at least 40% larger than the average circumference of the middle section. In typical embodiments, the maximum circumference of the bottom section is about 50% larger than the average circumference of the middle section. In some embodiments, the middle section is substantially cylindrical in shape, in that its circumference does not vary by more than 10% throughout. In other embodiments, as seen for example in FIG. 1A, the middle section has a narrower waist than its top and bottom ends.

Figure 6A:
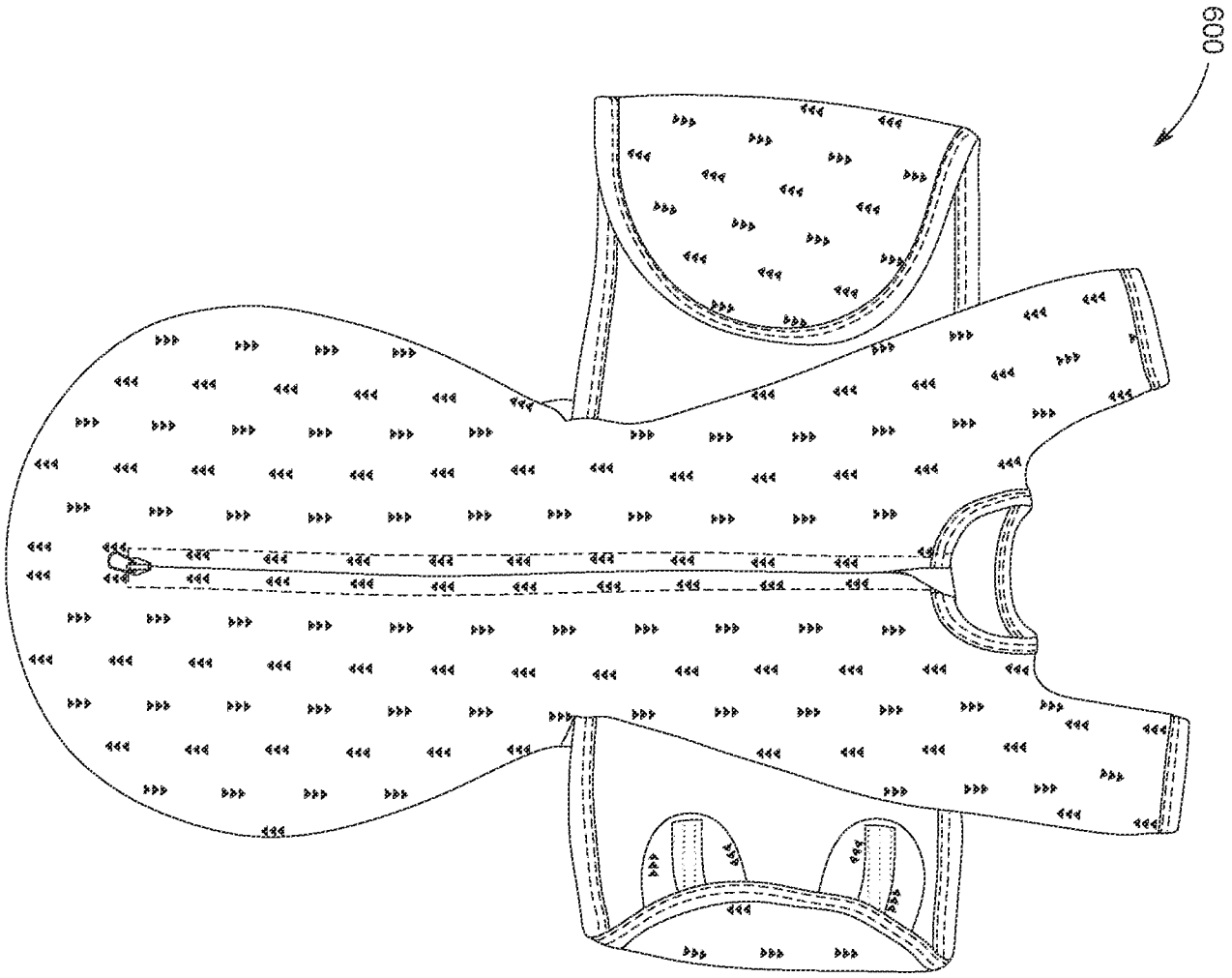
FIGS. 6A-6C are images showing views of an example embodiment of the swaddling device.
Figure 6B:
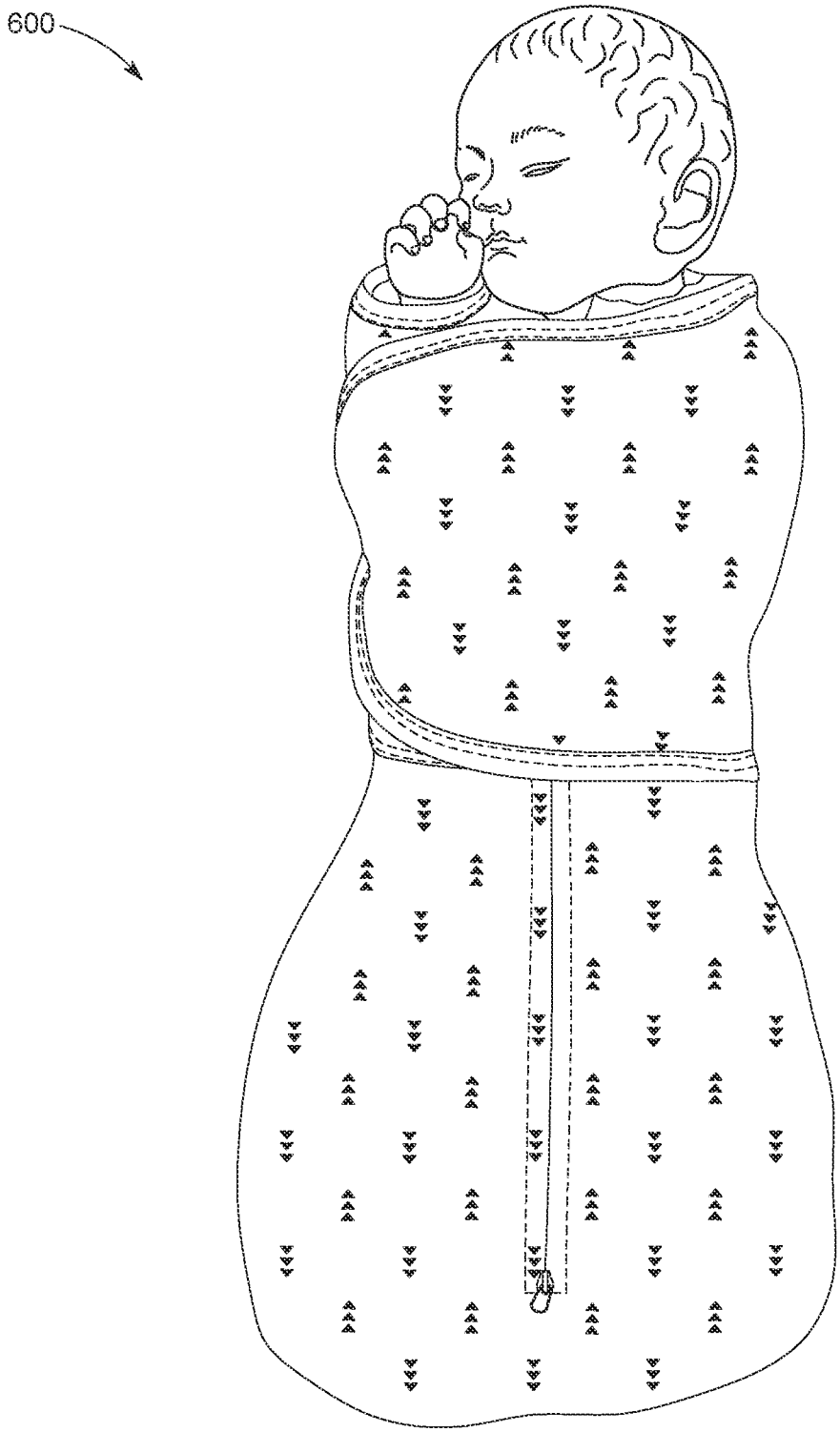
Figure 6C:
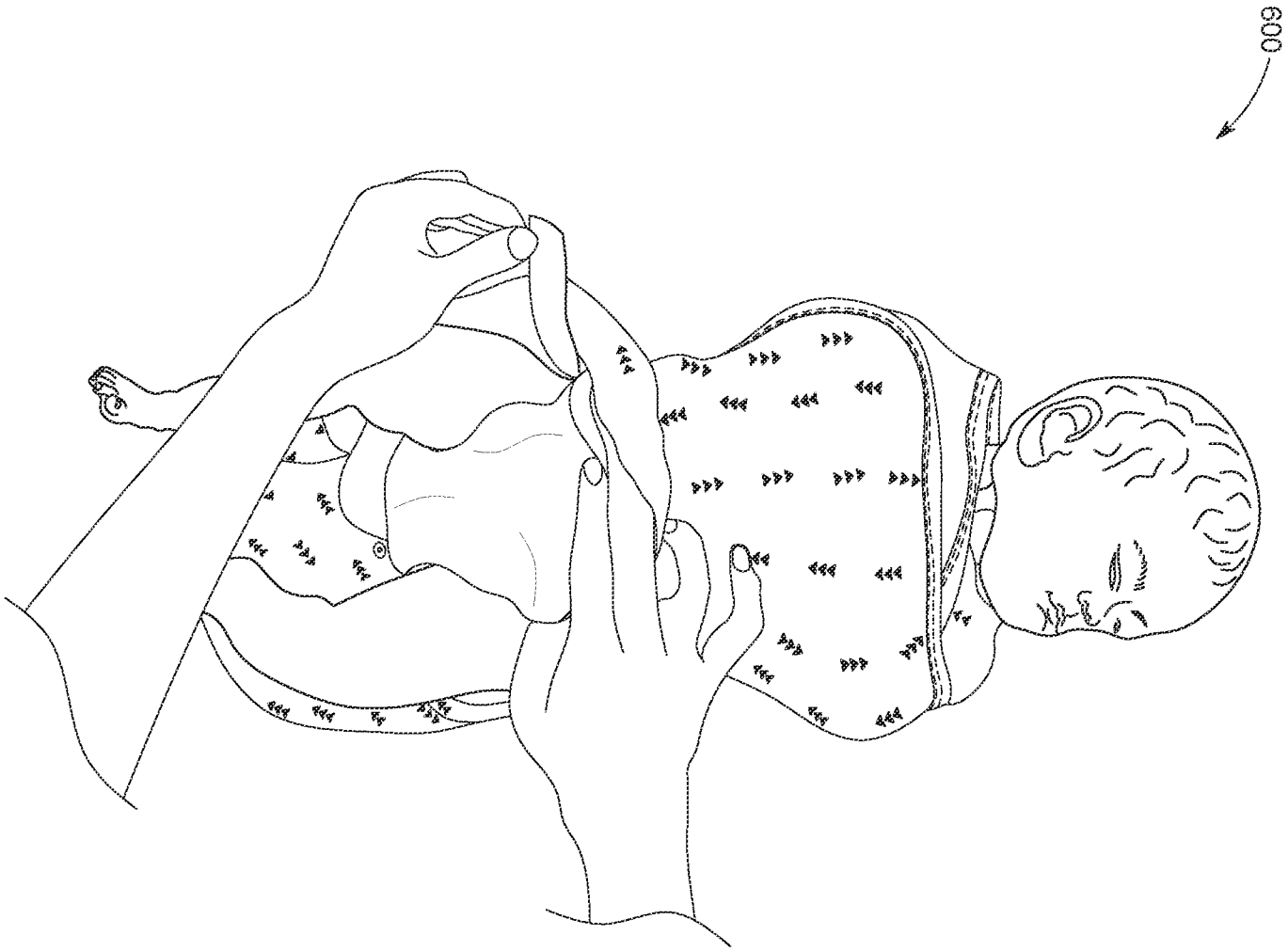

FIGS. 6A-6C are images showing multiple views of an example swaddling device 600. FIG. 6A shows the device 600 without baby. The device 600 has foldover cuffs in the open position. FIG. 6B shows the device 600 with a baby swaddled by the wrap. Note that the baby's right hand is exposed via the open foldover cuff. FIG. 6C shows the device with a baby swaddled by the wrap, but with both arms and hands enclosed by the wrap. FIG. 6C illustrates the access provided by the narrow wrap configuration, which allows a caregiver to access the diaper and legs of the baby without removing the wrap.

Embodiments shown and described herein may be manufactured largely from a front and rear fabric panel, sewn together along the respective perimeters of the panels. The fabric panels are made from a soft and stretchy cotton or substantially cotton-based fabric. In some cases, the fabric may include a synthetic elastic fiber, such as elastane. Various blends of cotton, synthetic, semi-synthetic, and/or elastic fiber may be employed.

While embodiments of the invention have been illustrated and described, as noted above, many changes can be made without departing from the spirit and scope of the invention. Accordingly, the scope of the invention is not limited by the above disclosure.

The invention claimed is:

1. A swaddling device in a shape of a pod, wearable blanket or sleeping sack, comprising:

a sack that has a left side, a right side, a top section, a middle section, and a bottom section, wherein the sack is configured to enclose a baby when the sack is worn, wherein the sack includes a neck opening, wherein the bottom section forms an enclosed space configured to surround both hips and legs of the baby and provides room for the baby's hips and knees to be flexed and/or abducted, thereby providing room for the baby to move one or both of its legs inside the enclosed bottom section of the sack, the bottom section having a rounded shape;

a first sleeve portion coupled to the sack at a first side of the neck opening;

a second sleeve portion coupled to the sack at a second side of the neck opening, wherein the second side is opposite the first side;

wherein the first and second sleeve portions are configured to extend upwards in a Y-shaped configuration with the distal ends above the shoulder line of the swaddling device, wherein the first and second sleeve portions are configured to restrict movement of the arms of the baby;

a wrap that is operable to swaddle the arms and a portion of the trunk of the baby, wherein the wrap extends along a first axis that is perpendicular to a second axis that runs from the neck opening to the bottom section of the sack, wherein the wrap has a length measured along the first axis, wherein the length is greater than a maximum circumference of the sack, wherein the wrap has a top end and a bottom end, wherein the top end is below the neck opening, wherein the bottom end is below the top end and above the bottom section of the sack, and wherein the wrap includes a panel of fabric that is attached to a rear fabric panel of the sack, and wherein the wrap is stitched to a front fabric panel of the sack, and wherein the swaddling device at least partially restricts movement of the baby and thereby suppresses a Moro reflex of the baby, while also snugly enveloping the torso of the baby and thereby providing constant moderate pressure thereto.

2. The swaddling device of claim 1, wherein the bottom section has an average circumference that is greater than an average circumference of the middle section, wherein the bottom section is configured to provide room for the baby to flex and extend the hips and knees of the baby while enclosed within the sack interior while moderately limiting the range of motion and providing partial suppression of the Moro reflex.

3. The swaddling device of claim 1, wherein the wrap has a maximum width measured along the second axis and between the top end and bottom end, wherein the maximum width is less than 13 inches.

4. The swaddling device of claim 1, wherein the bottom end of the wrap is no more than 4 inches below a narrowest portion of the middle section of the sack.

5. The swaddling device of claim 1, wherein the length of the wrap is at least 1.5 times the maximum circumference of the top section of the sack.

6. The swaddling device of claim 1, wherein the length of the wrap is at least 2 times the maximum circumference of the top section of the sack, and wherein the wrap does not include any fasteners.

7. The swaddling device of claim 1, wherein the wrap includes at least one hook and loop fastener that is configured to secure the wrap.

8. The swaddling device of claim 1.

9. The swaddling device of claim 1, wherein each of the first and the second sleeve portions have a distal end that is selectively openable by a caregiver, such that when the distal end is in an open position, a hand of the baby is exposed, and when the distal end is in a closed position, the hand of the baby is enclosed within the sleeve portion.

10. The swaddling device of claim 9, wherein each of the first and the second sleeve portion includes a foldover mitten cuff that is selectively openable by the caregiver, wherein the cuff is opened by turning material of the sleeve portion back on itself to allow access to the interior of the sleeve portion.

11. The swaddling device of claim 1, wherein the middle section is configured to provides moderate constant pressure on a baby's stomach, wherein the bottom section has an average circumference that is 50% greater than the circumference of the middle section.

12. The swaddling device of claim 1, wherein the wrap is operable to swaddle the baby while one or both arms of the baby are outside of the wrap, and wherein, when both arms of the baby are outside of the wrap, the top section of the sack partially suppresses arm movements related to the Moro reflex that further allows sufficient range of motion for baby to use his or her arms when prone to lift his or her torso and reposition his or her head.

13. The swaddling device of claim 1, wherein the first and second sleeve portions are configured to extend upwards in a Y-shaped configuration with the distal ends above the shoulder line of the swaddling device, and wherein the sleeve portions each have a sleeve length shorter than a standard long sleeve to allow baby to easily access and place his or her hands in mouth when the mitten cuffs are open.

14. The swaddling device of claim 1, wherein the sack includes a two-way zipper or snaps which provide ingress for the baby into the sack and egress for the baby out of the sack, wherein the zipper or snaps run from the neck opening downward through the middle section of the sack and to the bottom section of the sack, and wherein the zipper or snaps are operable to access a diaper worn by the baby even when the baby is enclosed in the wrap.

15. The swaddling device of claim 1, wherein the sleeve portions allow sufficient room for baby's arms and hands to be contained in the sleeve portion thereby allowing baby to sleep in multiple natural positions including hands on chest, hands in-line with shoulders with elbow by side of body arms reaching above shoulders in touchdown position, and where in the sleeves allow for limited movement and provide partial suppression of arm movements related to the Moro reflex.

16. A swaddling device in a shape of a pod, wearable blanket or sleeping sack, comprising:

a sack that includes a neck opening and that is configured to enclose a baby when the sack is worn; a first sleeve portion coupled to the sack at a first side of the neck opening; a second sleeve portion coupled to the sack at a second side of the neck opening, wherein the second side is opposite the first side; wherein each of the first and the second sleeve portions have a distal end that is selectively openable by a caregiver, such that when the distal end is in an open position, a hand of the baby is exposed, and when the distal end is in a closed position, the hand of the baby is enclosed within the sleeve portion;

a bottom section that forms an enclosed space is configured to surround both hips and legs of the baby and provides room for the baby's hips and knees to be flexed and/or abducted, thereby providing room for the baby to move one or both of its legs inside the enclosed bottom section of the sack, the bottom section having a rounded shape; and a wrap that is operable to swaddle the arms and a portion of the torso of the baby, wherein the wrap has a length that is greater than a maximum circumference of the sack, wherein the wrap has a bottom edge that is configured to be positioned above the hips of the baby, and wherein the wrap includes a panel of fabric that is attached to a rear fabric panel of the sack, and wherein the wrap is stitched to a front fabric panel of the sack, and wherein the swaddling device at least partially restricts movement of the baby and thereby suppresses a Moro reflex of the baby, while also snugly enveloping the stomach of the baby and thereby providing constant moderate pressure thereto.

17. The swaddling device of claim 16, wherein the sack includes a front panel and rear panel, and wherein the wrap is attached to the front panel by stiches at two separate locations.

18. The swaddling device of claim 16, the sack having a top section and the bottom section, wherein the wrap has a maximum width measured along a horizonal axis and between the top section and the bottom section, wherein the maximum width is less than 13 inches.

19. The swaddling device of claim 16, wherein a bottom end of the wrap is no more than 4 inches below the a narrowest portion of a middle section of the sack.

20. The swaddling device of claim 16, the sack having a top section and the bottom section, wherein a length of the wrap is at least 1.5 times the maximum circumference of the top section of the sack.

21. The swaddling device of claim 16, wherein the wrap includes at least one hook and loop fastener, snaps, and/or a zipper that is configured to secure the wrap.

22. The swaddling device of claim 16, wherein the first and second sleeve portions are configured to extend upwards in a Y-shaped configuration with the distal ends above the shoulder line of the swaddling device, wherein the first and second sleeve portions are configured to restrict movement of the arms of the baby.

23. The swaddling device of claim 22 wherein the sleeve portions each have a sleeve length shorter than a standard long sleeve is configured to allow baby to easily access and place his or her hands in mouth when the mitten cuffs are open.

24. The swaddling device of claim 16, the sack having a top section, a middle section, and the bottom section, wherein the middle section is configured to provide moderate constant pressure on a baby's stomach, wherein the bottom section has an average circumference that is 50% greater than the circumference of the middle section.

25. The swaddling device of claim 16, the sack having a top section, a middle section, and a bottom section, wherein the wrap is operable to swaddle the baby while one or both arms of the baby are outside of the wrap, and wherein, when both arms of the baby are outside of the wrap, the top section of the sack partially suppresses arm movements related to the Moro reflex that further allows sufficient range of motion for baby to use his or her arms when prone to lift his or her torso and reposition his or her head.

26. A swaddling device in a shape of a pod, wearable blanket or sleeping sack, comprising:

a sack that includes a neck opening and that is configured to enclose a baby when the sack is worn;

a first sleeve portion coupled to the sack at a first side of the neck opening;

a second sleeve portion coupled to the sack at a second side of the neck opening, wherein the second side is opposite the first side;

wherein the first and second sleeve portions are configured to extend upwards in a Y-shaped configuration with the distal ends above the shoulder line of the swaddling device, wherein the first and second sleeve portions are configured to restrict movement of the arms of the baby;

a bottom section that forms an enclosed space is configured to surround both hips and legs of the baby and provides room for the baby's hips and knees to be flexed and/or abducted, thereby providing room for the baby to move one or both of its legs inside the enclosed bottom section of the sack, the bottom section having a rounded shape; and a wrap that is operable to swaddle the arms and a portion of the torso of the baby, wherein the wrap has a length that is greater than a maximum circumference of the sack, wherein the wrap has a bottom edge that is configured to be positioned above the hips of the baby, and wherein the wrap includes a panel of fabric that is attached to a rear fabric panel of the sack, and wherein the wrap is stitched to a front fabric panel of the sack, and wherein the swaddling device at least partially restricts movement of the baby and thereby suppresses a Moro reflex of the baby, while also snugly enveloping the stomach of the baby and thereby providing constant moderate pressure thereto.

27. The swaddling device of claim 26, wherein each of the first and the second sleeve portions have a distal end that is selectively openable by a caregiver, such that when the distal end is in an open position, a hand of the baby is exposed, and when the distal end is in a closed position, the hand of the baby is enclosed within the sleeve portion.

28. The swaddling device of claim 26, wherein the wrap is operable to swaddle the baby while one or both arms of the baby are outside of the wrap, and wherein, when both arms of the baby are outside of the wrap, the top section of the sack partially suppresses arm movements related to the Moro reflex that further allows sufficient range of motion for baby to use his or her arms when prone to lift his or her torso and reposition his or her head.

29. The swaddling device of claim 26, wherein the sleeve portions each have a sleeve length shorter than a standard long sleeve to allow baby to easily access and place his or her hands in mouth when the mitten cuffs are open.

* * * * *